US009230553B2

(12) United States Patent
Morii

(10) Patent No.: US 9,230,553 B2
(45) Date of Patent: Jan. 5, 2016

(54) FIXED CODEBOOK SEARCHING BY CLOSED-LOOP SEARCH USING MULTIPLEXED LOOP

(75) Inventor: Toshiyuki Morii, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 347 days.

(21) Appl. No.: 13/819,421

(22) PCT Filed: Jun. 5, 2012

(86) PCT No.: PCT/JP2012/003674

§ 371 (c)(1),
(2), (4) Date: Feb. 27, 2013

(87) PCT Pub. No.: WO2012/172750

PCT Pub. Date: Dec. 20, 2012

(65) Prior Publication Data

US 2013/0166306 A1 Jun. 27, 2013

(30) Foreign Application Priority Data

Jun. 15, 2011 (JP) ..... 2011-133750

(51) Int. Cl.
*G10L 19/10* (2013.01)
*G10L 19/00* (2013.01)

(52) U.S. Cl.
CPC ..... *G10L 19/10* (2013.01); *G10L 19/00* (2013.01)

(58) Field of Classification Search
USPC ..... 704/219, 500
See application file for complete search history.

(56) References Cited

U.S. PATENT DOCUMENTS 6,728,669 B1 * 4/2004 Benno ..... G10L 19/10 704/219
8,959,018 B2 * 2/2015 Ma ..... G10L 19/107 341/50

(Continued)

FOREIGN PATENT DOCUMENTS

CN 1811917 8/2006
CN 101866650 10/2010

(Continued)

OTHER PUBLICATIONS

"Series G: Transmission Systems and Media, Digital Systems and Networks ", ITU-T G.718, Jun. 2008, pp. 1-246.
English Translation of Chinese Serch Report, Dated Jan. 23, 2014.

*Primary Examiner* — Peter K Huntsinger
*Assistant Examiner* — Walter Yehl
(74) *Attorney, Agent, or Firm* — Greenblum & Bernstein, P.L.C.

(57) ABSTRACT

A pulse location search device (400) is equipped with: a first search unit (401) that obtains a first location where a first pulse is located by conducting a first preliminary selection with respect to a first candidate group, and conducting a first search; a second search unit (402) that obtains a second location where a second pulse is located by using the first location and conducting a second search with respect to all of the location candidates of a second candidate group of locations where the second pulse is located; and a third search unit (403) that obtains a third location where the first pulse is located by using the second location and conducting a second preliminary selection with respect to the first candidate group, and conducting a third search with respect to the result of the second preliminary selection.

2 Claims, 13 Drawing Sheets

(56) References Cited

U.S. PATENT DOCUMENTS

2002/0007272 A1* 1/2002 Ozawa ..... G10L 19/10 704/223
2002/0095284 A1* 7/2002 Gao ..... G10L 21/0364 704/219
2006/0074641 A1* 4/2006 Goudar ..... G10L 19/08 704/219
2006/0149540 A1* 7/2006 Singh ..... G10L 19/107 704/223
2009/0240493 A1* 9/2009 Zhang ..... G10L 19/10 704/219
2010/0191526 A1* 7/2010 Morii ..... G10L 19/107 704/219
2010/0280831 A1* 11/2010 Salami ..... G10L 19/107 704/500

FOREIGN PATENT DOCUMENTS

| | | |
|---|---|---|
| JP | 11-119799 | 4/1999 |
| JP | 2001-022400 | 1/2001 |
| JP | 2004-252490 | 9/2004 |
| WO | 2009/016816 | 2/2009 |

* cited by examiner

FIXED CODEBOOK SEARCHING BY CLOSED-LOOP SEARCH USING MULTIPLEXED LOOP

TECHNICAL FIELD

The claimed invention relates to a pulse position searching apparatus that searches positions of a plurality of pulses, a method thereof and a codebook searching apparatus that searches positions of a plurality of pulses making up a codebook and a method thereof.

BACKGROUND ART

In mobile communication, compression coding of digital information of speech or image is indispensable for effective use of a transmission band. Among those technologies, there are high expectations of speech CODEC technologies widely used for mobile phones and there is a growing demand for better sound quality with respect to conventional high efficiency coding with a high compressibility. Furthermore, since the technologies are used in public, standardization is indispensable, and because of powerful intellectual property rights involved, research and development are being actively conducted in many companies worldwide.

In recent years, the standardization of CODEC capable of coding both speech and music is under study in ITU-T and MPEG, and there is a demand for more efficient and higher quality speech CODEC.

Performance of speech coding technologies has been greatly improved by CELP (Code Excited Linear Prediction) which is a basic scheme that models a speech vocalization mechanism established 20 years ago and skillfully applies vector quantization. CELP is adopted as many standard schemes in international standards such as ITU-T (International Telecommunication Union-Telecommunication Standardization Sector) standard G.729, ITU-T standard G.722.2, ETSI (European Telecommunications Standards Institute) standard AMR (Adaptive Multiple Rate Coding), ETSI standard AMR-WB (Adaptive Multiple Rate Coding-Wide Band) or 3GPP (3rd Generation Partnership Project) 2 standard VMR-WB (Variable Multiple rate-Wide Band).

FIG. 1 is a block diagram illustrating a configuration of a CELP coding apparatus. In FIG. 1, spectral parameters (LSP, ISP or the like) in CELP are quantized.

In FIG. 1, LPC analyzing section 101 applies linear predictive analysis (LPC analysis) to a speech signal, acquires an LPC parameter which is spectral envelope information and outputs the acquired LPC parameter to LPC quantization section 102 and perceptual weighting section 111.

LPC quantization section 102 quantizes the LPC parameter outputted from LPC analyzing section 101. LPC quantization section 102 then outputs the acquired quantized LPC parameter to LPC synthesis filter 109 and outputs an index (code) of the quantized LPC parameter to the outside of CELP coding apparatus 100.

On the other hand, adaptive codebook 103 stores past excitation used in LPC synthesis filter 109, and generates an excitation vector corresponding to one subframe from excitation vectors stored according to an adaptive codebook lag corresponding to an index indicated from distortion minimizing section 112, which will be described later. This excitation vector is outputted to multiplier 106 as an adaptive codebook vector.

Fixed codebook 104 is a codebook of excitation coding (also referred to as "excitation quantization" or "excitation vector coding"). Fixed codebook 104 stores beforehand a plurality of excitation vectors having a predetermined shape and outputs an excitation vector corresponding to the index indicated from distortion minimizing section 112 to multiplier 107 as a fixed codebook vector. Here, fixed codebook 104 is an algebraic excitation, and a case using an algebraic codebook will be described. The algebraic excitation is an excitation adopted in many standard CODECs.

Above-described adaptive codebook 103 is used to express a component with strong periodicity such as voiced sound. On the other hand, fixed codebook 104 is used to express a component with weak periodicity such as white noise.

Gain codebook 105 generates a gain for the adaptive codebook vector (adaptive codebook gain) outputted from adaptive codebook 103 and a gain for the fixed codebook vector (fixed codebook gain) outputted from fixed codebook 104, according to an instruction from distortion minimizing section 112 and outputs the respective gains to multipliers 106 and 107.

Multiplier 106 multiplies the adaptive codebook vector outputted from adaptive codebook 103 by the adaptive codebook gain outputted from gain codebook 105 and outputs the adaptive codebook vector after the multiplication to adder 108.

Multiplier 107 multiplies the fixed codebook vector outputted from fixed codebook 104 by the fixed codebook gain outputted from gain codebook 105 and outputs the fixed codebook vector after the multiplication to adder 108.

Adder 108 adds up the adaptive codebook vector outputted from multiplier 106 and the fixed codebook vector outputted from multiplier 107 and outputs the excitation vector after the addition to LPC synthesis filter 109 as an excitation.

LPC synthesis filter 109 generates a synthesized signal using a filter function, that is, LPC synthesis filter using the quantized LPC parameter outputted from LPC quantization section 102 as a filter coefficient and the excitation vector generated in adaptive codebook 103 and fixed codebook 104 as an excitation. This synthesized signal is outputted to adder 110.

Adder 110 calculates an error signal by subtracting the synthesized signal generated in LPC synthesis filter 109 from the speech signal and outputs this error signal to perceptual weighting section 111. This error signal corresponds to coding distortion.

Perceptual weighting section 111 applies perceptual weighting to the coding distortion outputted from adder 110 using the LPC parameter inputted from LPC analyzing section 101 and outputs the weighted distortion to distortion minimizing section 112.

Distortion minimizing section 112 acquires each index (code) of adaptive codebook 103, fixed codebook 104 and gain codebook 105 such that the coding distortion outputted from perceptual weighting section 111 becomes a minimum for each subframe and outputs these indices to the outside of CELP coding apparatus 100 as coded information. To be more specific, distortion minimizing section 112 generates a synthesized signal based on above-described adaptive codebook 103 and fixed codebook 104, a series of processes of acquiring coding distortion of this signal constitutes closed-loop control (feedback control) and distortion minimizing section 112 searches each codebook by changing the index to be indicated to each codebook in various ways within one subframe and outputs the finally acquired index of each codebook that minimizes coding distortion.

With an algebraic codebook used as a fixed codebook (also referred to as "stochastic codebook"), better coding performance can be obtained with a limited amount of calculation. The algebraic codebook is widely used in above-described ITU-T standard G.729, ITU-T standard G.722.2, ETSI standard AMR or ETSI standard AMR-WB or the like.

Here, the principles of the basic algorithm of fixed codebook search will be described.

First, a search for an excitation vector (also called "codebook vector" or "code vector") and derivation of the code will be performed by searching an excitation vector that minimizes coding distortion of equation 1 below.

$$E=|u-(pHa+qHs)|^2 \quad \text{(Equation 1)}$$

where E is coding distortion, u is a coding target, p is a gain of the adaptive codebook vector, H is a perceptual weighting synthesis filter, a is an adaptive codebook vector, q is a gain of the fixed codebook vector, and s is a fixed codebook vector.

Since the adaptive codebook vector and the fixed codebook vector are generally searched through sequential optimization (in separate loops), the code of fixed codebook 104 is derived by searching the fixed codebook vector that minimizes coding distortion in equation 2 below.

$$v=u-pHa$$

$$E=|v-qHs|^2 \quad \text{(Equation 2)}$$

where E is coding distortion, u is a coding target (perceptual weighted speech signal), p is an optimum gain of the adaptive codebook vector, H is a perceptual weighting synthesis filter, a is an adaptive codebook vector (also called "adaptive excitation"), q is a gain of the fixed codebook vector (also called "fixed excitation"), s is a fixed codebook vector, and v is a target vector of a fixed codebook search (also called "fixed excitation search").

Here, since gains p and q are determined after searching the code of the excitation, the search will be continued with ideal gains (also called "optimum gain"). The ideal gain means a gain that minimizes coding distortion. Therefore, equation 2 above may also be expressed as equation 3 below.

(Equation 3)

$$v = u - \frac{u \cdot Ha}{|Ha|^2} \quad [3]$$

$$E = \left| v - \frac{v \cdot Hs}{|Hs|^2} Hs \right|^2$$

Minimizing equation 3 indicating coding distortion is equal to maximizing cost function C of equation 4 below.

(Equation 4)

$$C = \frac{(v^t H \cdot s)^2}{s^t H^t Hs} \quad [4]$$

Therefore, in the case of a search for fixed codebook vector s composed of a small number of pulses such as an algebraic codebook, if $v^tH$ and $H^tH$ are calculated beforehand, above-described cost function C can be calculated with a small amount of calculation. That is, coding of the algebraic codebook is performed using an algorithm of searching a position and polarity that maximize above-described cost function C through a multiplexed loop of the same number of channels (also called "tracks") as that of pulses.

Furthermore, in the case of the pulse excitation, by preliminarily selecting the polarity based on whether the value of $v^tH$ is positive or negative simultaneously with multiplying the value of $v^tH$ and the value of $H^tH$ by the polarity, a polarity search can be omitted when searching pulse positions. This preliminary selection of polarity allows the amount of calculation to be exponentially saved.

In recent years, CODEC for encoding a wideband signal (16 kHz sampling) and an ultra-wideband signal (32 kHz sampling) is required in order to meet the need of higher quality, and the standardization is being carried forward in ITU-T, MPEG (Moving Picture Experts Group) or 3GPP or the like. As the bit rate for encoding wideband and ultra-wideband digital signals increases, the number of information bits of the fixed codebook for encoding an excitation also increases. The algebraic codebook allows high performance to be obtained through a search in simultaneous optimization (multiplexed loop), and therefore when the number of bits increases (the number of pulses increases), the amount of calculation increases exponentially.

Thus, in high quality CODEC, a method is widely adopted whereby pulses (channels or tracks) to be searched are divided into several groups, a search within each group is performed through a simultaneous optimization search and a search between groups is performed through sequential optimization. For example, when there are 32 candidates for positions at which one pulse among four pulses rises, 1048576 (32 to the fourth power) matching operations need to be performed. However, if four pulses are divided into two groups of two pulses each to be searched, performing a calculation of 32 to the second power twice requires only 2048 matching operations. In this case, since this search is a sequential optimization search, performance drops to a certain extent compared to a full simultaneous optimization search, but since the group is closed, there is no significant deterioration. For this reason, searches are performed by this grouping in recent years.

As an example of this pulse search, a case will be described using FIG. 2 where a search is performed assuming that the group size is two pulses. FIG. 2 is a conceptual diagram illustrating a flow of conventional fixed codebook search processing. The flow of search processing of a fixed codebook can be expressed as shown in FIG. 2 in a simplified manner. As shown in FIG. 2, two-pulse searches are performed the required number of times until the required number of pulses are searched. The results (pulses) obtained through the respective two-pulse searches are organized into a pulse sequence (not shown). There are various methods for organizing the results of two-pulse searches. For example, ITU-T standard G.718 uses an algorithm of increasing the number of pulses while searching two pulses at a time in a four-track configuration (see NPL 1). Here, the description thereof will be omitted.

FIG. 3 is a diagram schematically illustrating an algorithm of searching pulse positions by conventional grouping. FIG. 3 corresponds to one of the two-pulse searches in FIG. 2.

Before starting a search, parameters necessary for the search are determined using an inputted target or the like as preprocessing. Here, the target can be expressed by a vector and the target corresponds to target vector v of the aforementioned fixed codebook search. As parameters, target time inverse order synthetic vector (polarity preliminarily selected) $v^tH$, correlation matrix between pulse synthetic vectors (polarity preliminarily selected) $H^tH$, track number, and interval of pulse candidate positions of each track or the like are provided.

A search loop of track 1 is executed in a search loop of track 0 using these parameters. That is, the search loop of track 0 and the search loop of track 1 constitute a multiplexed loop. By conducting a search using this multiplexed loop, it is possible to obtain the searched position of each track, a correlation value forming the base of a synthetic numerator term until this search and a synthetic denominator term until this search.

FIG. 4 is a flowchart indicating an algorithm of searching pulse positions by conventional grouping. FIG. 4 is a more specific illustration of FIG. 3.

In FIG. 4, symbol "d[n]" is a target time inverse order synthetic vector (polarity preliminarily selected). Symbol "c[n][m]" denotes a correlation matrix (polarity preliminarily selected) between pulse synthetic vectors, where n≠m and values of n and m are doubled. Symbols "x" and "y" denote pulse candidate positions. Symbols "xx" and "yy" denote finally searched pulse positions. "Track 0" or "track 1" denotes a track number (one of 0, 1, 2 and 3 in FIG. 2). Symbol "ps_t" denotes the base of the numerator term of cost function C until before performing a search. Symbol "alp_t" denotes a synthetic value of the denominator term of cost function C until before performing a search. Symbol "L" denotes a subframe length. Symbol "step" denotes an interval of pulse candidate positions of each track ("4" in FIG. 4).

In FIG. 4, the flow starts when the aforementioned necessary parameters are inputted first. Then, to search pulse candidate position x, numerator term sqk of cost function C is set to "−1.0" and denominator term alpk is set to "1.0" (step ST11).

Next, it is determined whether or not pulse candidate position x is smaller than subframe length L (step ST12).

When pulse candidate position x is smaller than subframe length L (step ST12: yes), calculations ps0=ps_t+d[x] and alp0=alp_t+c[x][x] are performed (step ST13).

Next, a search of pulse candidate position y is started (step ST14), and it is determined whether or not pulse candidate position y is smaller than subframe length L (step ST15).

When pulse candidate position y is equal to or greater than subframe length L (step ST15: no), the next candidate position is selected (x=x+step) (step ST16) and the process is returned to step ST12.

On the other hand, when pulse candidate position y is smaller than subframe length L (step ST15: yes), calculations ps1=ps0+d[y], alp1=alp0+c[y][y]+c[x][y] and sq=ps1*ps1 are performed (step ST17).

Next, it is determined whether or not the value of (alpk*sq) is greater than the value of (sqk*alp1) (step ST18).

When the value of (alpk*sq) is equal to or smaller than the value of (sqk*alp1) (step ST18: no), the next candidate position is selected (y=y+step) (step ST19), and the process is returned to step ST15.

On the other hand, when the value of (alpk*sq) is greater than the value of (sqk*alp1) (step ST18: yes), the denominator term and the numerator term of cost function C are fixed, finally searched pulse positions xx and yy are fixed (step ST20), and the process is returned to step ST19.

Furthermore, in step ST12, when pulse candidate position x is equal to or greater than subframe length L (step ST12: no), ps_t=ps_t+d[xx]+d[yy] is calculated, and the denominator term of cost function C before conducting a search is determined to be the final denominator term of cost function C (step ST21).

Next, final pulse positions xx and yy, and synthetic value alp_t of the denominator term of cost function C and the value of numerator term ps_t of cost function C in that case are outputted (step ST22).

In FIG. 4, the numerator term of cost function C in equation 4 is sq and the denominator term is alp1. Cost function C is obtained by dividing the numerator term by the denominator term, but since the division involves a large amount of calculation, cross-multiplication is adopted when determining the magnitude of cost function C.

However, even when the above-described grouping is used, if the number of bits further increases, the amount of calculation becomes enormous.

Thus, ITU-T standard G.718 adopts a preliminary selection of pulse positions when searching pulses (see NPL 1). The preliminary selection of pulse positions means that positions where pulses are likely to rise or assumed to rise are selected beforehand from among pulse candidate positions to thereby reduce the number of pulse candidate positions that are included in the next loop.

An overview of a flow of search processing of the fixed codebook using a preliminary selection of pulse positions adopted in G.718 will be described using FIG. 5. FIG. 5 is a conceptual diagram illustrating a flow of conventional fixed codebook search processing. As described above, there are various methods of organizing the two-pulse search results, and G.718 uses an algorithm of increasing the number of pulses while searching two pulses at a time in a four-track configuration. Here, the description thereof will be omitted.

As shown in FIG. 5 as in the case of FIG. 2, this search processing of the fixed codebook performs two-pulse searches the required number of times, but performs a preliminary selection in the respective two-pulse searches. At this time, a relationship in ascending order of magnitude is set in the preliminary selection number of the respective two-pulse searches.

FIG. 6 is a diagram schematically illustrating an algorithm of searching pulse positions when performing a preliminary selection of pulse positions adopted in G.718. FIG. 6 corresponds to one of the two-pulse searches shown in FIG. 5.

As in the case of FIG. 3, before starting a search, parameters necessary for the search are acquired using an inputted target or the like as preprocessing. Here, the target can be expressed by a vector and corresponds to target vector v of the aforementioned fixed codebook search. As parameters, target time inverse order synthetic vector (polarity preliminarily selected) $v^tH$, correlation matrix between pulse synthetic vectors (polarity preliminarily selected) $H^tH$, track number, and interval of pulse candidate positions of each track or the like are provided.

By performing a preliminary selection of track 0 in the search loop of track 0 using these parameters, the number of times of entering the search loop of track 1 in the search loop of track 0 is limited. In the case of FIG. 6 as in the case of FIG. 3, the search loop of track 0 and the search loop of track 1 also constitute a multiplexed loop. By conducting a search using this multiplexed loop, the searched position of each track, correlation value forming the base of the synthetic numerator term until this search and the synthetic denominator term until this search are obtained.

FIG. 7 is a flowchart illustrating an algorithm of searching pulse positions when performing a preliminary selection of pulse positions adopted in G.718. FIG. 7 is a more specific illustration of FIG. 6. In FIG. 7, parts having the same processing as that in FIG. 4 are assigned the same reference numerals and descriptions thereof will be omitted.

In FIG. 7, symbol "pick[n]" denotes a sequence in which the order of adopting each pulse position is described in the pulse position. Symbol "thres" denotes a value acquired from the number of candidates of specified candidate position x. Furthermore, the specified number of candidates are searched through a search only when pick[n] is a value smaller than the value of thres. Meanings of the other symbols are the same as those in FIG. 4, and so descriptions thereof will be omitted.

In FIG. 7, when pulse candidate position x is smaller than subframe length L (step ST12: yes), it is determined whether or not pick[x] is smaller than the value of thres (step ST50).

When pick[x] is smaller than the value of thres (step ST50: yes), calculations ps0=ps_t+d[x] and alp0=alp_t+c[x][x] are performed (step ST13).

On the other hand, when pick[x] is equal to or greater than the value of thres (step ST50: no), the next candidate position is selected (step ST16), and the process is returned to step ST12.

FIG. 8 is a block diagram illustrating a configuration of fixed codebook searching apparatus 300 that can conduct a pulse search of the fixed codebook using the above-described conventional pulse searching method.

Preprocessing section 301 receives a target signal as input and acquires parameters necessary for a pulse search. Examples of parameters generated by calculation include "target time inverse order synthetic vector" (corresponding to $v'H$ in equation 4) for which a polarity preliminary selection of each pulse position is performed and the result thereof is reflected, and "correlation matrix between pulse synthetic vectors" (corresponding to $H'H$ in equation 4) for which the result of the polarity preliminary selection is reflected and values other than the diagonal term are doubled. Furthermore, examples of the parameters to be set include a track number to be searched, interval of pulse position candidates of the track with the number, subframe length and preliminary selection number. Preprocessing section 301 sends these parameters to control section 302.

Control section 302 receives the total number of bits as input, sends parameters necessary for a pulse search to multiplexed loop searching section 303 according to a timing signal from pulse sequence coding section 304, which will be described later, and controls multiplexed loop searching section 303 so as to conduct a pulse search. Examples of the parameters to be sent to multiplexed loop searching section 303 include, in addition to parameters sent from preprocessing section 301, a sequence in which the order of adopting each pulse position is described in the pulse position, a synthetic value of the numerator term and a synthetic value of the denominator term until before conducting a search. Control section 302 initializes the synthetic value of the numerator term and the synthetic value of the denominator term until before conducting a search when first driving multiplexed loop searching section 303 and sends the synthetic values sent from pulse sequence coding section 304 to multiplexed loop searching section 303 when conducting two-pulse searches in subsequent stages.

Multiplexed loop searching section 303 searches pulse positions using the multiplexed loop. In this case, multiplexed loop searching section 303 performs a preliminary selection in the outermost loop using the preliminary selection number and the sequence in which the order of adopting each pulse position is described in the pulse position, and outputs the searched pulse position, and the synthetic value of the numerator term and the synthetic value of the denominator term calculated in the pulse positions, to pulse sequence coding section 304.

Pulse sequence coding section 304 performs pulse coding using the pulse position searched by multiplexed loop searching section 303, the synthetic value of the numerator term and the synthetic value of the denominator term. Pulse coding as this fixed codebook is performed using the result of multiplexed loop searching section 303 operating a plurality of times. Pulse sequence coding section 304 sends the synthetic value of the numerator term and the synthetic value of the denominator term to control section 302 and sends a timing signal for urging multiplexed loop searching section 303 to perform the next operation to control section 302. Pulse sequence coding section 304 then finally outputs the code as the fixed codebook.

Here, when using the search processing in FIG. 2 as the pulse searching method, multiplexed loop searching section 303 does not include any configuration to perform a preliminary selection. As the pulse searching method, when the search processing in FIG. 5 is used, multiplexed loop searching section 303 is configured to perform a preliminary selection.

Thus, in order to adapt to a high bit rate fixed codebook search, methods have been conventionally invented such as a method of grouping channels (tracks) in an algebraic codebook to conduct a search in units of a small number of pulses and conduct individual searches for a small number of pulses in a closed loop, and further a method of performing a preliminary selection of positions in an outside loop then to further reduce the amount of calculation, so that high quality speech or music can be encoded while suppressing the amount of calculation.

CITATION LIST

Non-Patent Literature

NPL 1
ITU-T standard G.718 specifications, June 2008

SUMMARY OF INVENTION

Technical Problem

However, since a multiplexed loop is adopted in a conventional apparatus, there is a problem that it is difficult to further reduce the amount of calculation involved in a pulse position search. For this reason, when the number of pulses searched in the fixed codebook increases, there is a problem that it is difficult to reduce the amount of calculation involved in a pulse position search without deterioration of the coding performance.

It is an object of the claimed invention to provide a pulse position searching apparatus and a method thereof capable of reducing the amount of calculation involved in a pulse position search. Furthermore, as for a codebook, it is an object of the claimed invention to provide a codebook searching apparatus and a method thereof capable of, even when the number of pulses to be acquired by a search increases, reducing the amount of calculation involved in a pulse position search without deterioration of the coding performance.

Solution to Problem

A pulse position searching apparatus according to the claimed invention is a pulse position searching apparatus that obtains, as input, parameters obtained by performing predetermined processing on a target signal, and searches a plurality of pulse positions, and adopts a configuration including: a first searching section that performs a first preliminary selection using the parameters on a first candidate group of positions where a first pulse is placed, and performs a first search on the result of the first preliminary selection to obtain a first position where the first pulse is placed; a second searching section that performs a second search using the first position on all position candidates of a second candidate group of positions where a second pulse is placed, to thereby obtain a second position where the second pulse is placed; and a third searching section that performs a second preliminary selection using the second position on the first candidate group, performs a third search on the result of the second preliminary selection to thereby obtain a third position where the first pulse is placed, and outputs the second position and the third position as a search result.

A pulse position searching method according to the claimed invention is a pulse position searching method that obtains, as input, parameters obtained by performing predetermined processing on a target signal, and searches a plurality of pulse positions, the method including: a first searching step of performing a first preliminary selection using the parameters on a first candidate group of positions where a first pulse is placed, and performing a first search on the result of the first preliminary selection to obtain a first position where the first pulse is placed; a second searching step of performing a second search using the first position on all position candidates of a second candidate group of positions where a second pulse is placed, to thereby obtain a second position where the second pulse is placed; and a third searching step of performing a second preliminary selection using the second position on the first candidate group, performing a third search on the result of the second preliminary selection to thereby obtain a third position where the first pulse is placed, and outputting the second position and the third position as a search result.

Advantageous Effects of Invention

The pulse position searching apparatus and the method thereof according to the claimed invention can further reduce the amount of calculation involved in a pulse position search compared to related art. Furthermore, applying this pulse position searching apparatus and the method thereof to a codebook searching apparatus and the method thereof makes it possible to reduce the amount of calculation involved in a pulse position search without deterioration of the coding performance even when the number of pulses to be obtained by a search increases.

DESCRIPTION OF EMBODIMENTS

Figure 1:
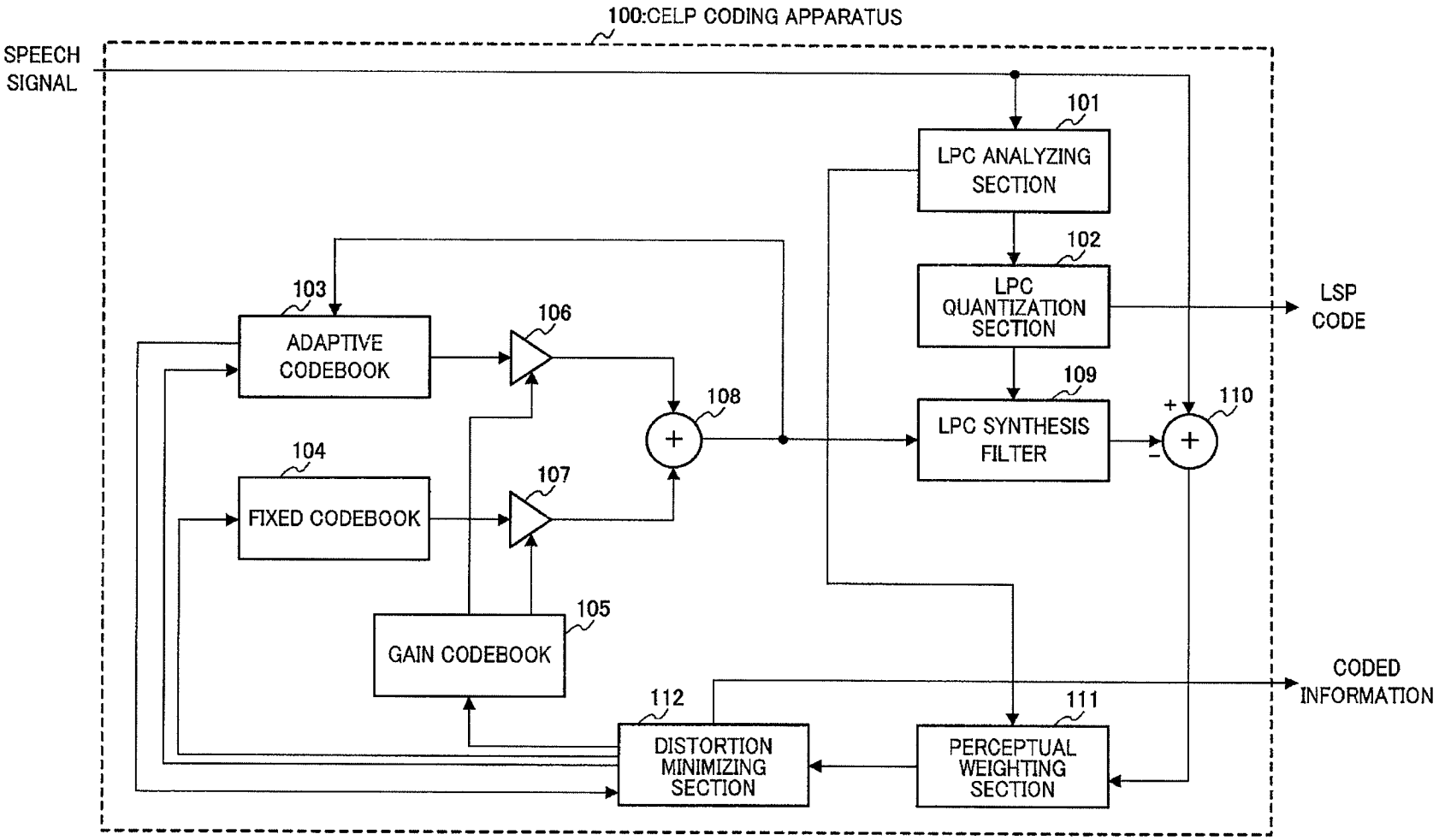
FIG. 1 is a block diagram illustrating a configuration of a CELP coding apparatus.
Figure 2:
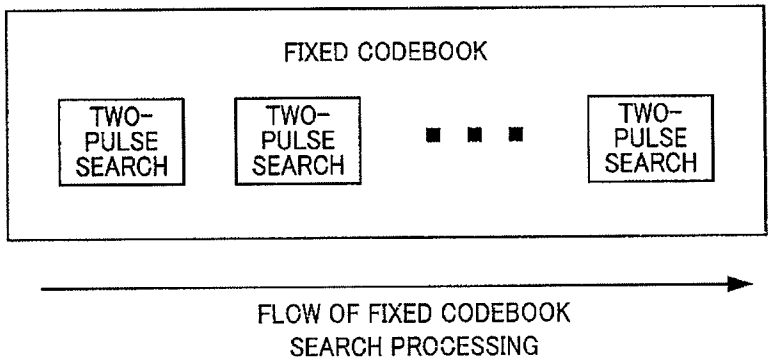
FIG. 2 is a conceptual diagram illustrating a flow of conventional fixed codebook search processing.

The claimed invention relates to quantization that performs coding by combining a plurality of searches for a small number of pulses to search many pulses. There are two types of searches for a small number of pulses: one using a loop of a channel (called "track" or "pulse") for performing a preliminary selection (that is, limits a search target first) and the other using a loop of a channel for not performing any preliminary selection (that is, all candidates are considered to be search targets). The claimed invention has a feature of performing a sequential optimization search whereby the respective loops are sequentially performed without multiplexing the loops. The loop for which a preliminary selection is performed is preferably used a plurality of times for a sequential optimization search used to search for a small number of pulses. Particularly, the loop for which a preliminary selection is performed is more preferably used as at least the first loop and the last loop in the order in which loops are executed. The claimed invention relates to a pulse position searching apparatus that searches a small number of pulses using such a pulse position searching method.

If a sequential optimization search for the above-described pulse position searching apparatus is used in a case where the preliminary selection number is sufficiently small, its performance does not significantly deteriorate from the performance of conventional simultaneous optimization search with a preliminary selection. Moreover, since the loop in question is not a multiplexed loop, the amount of calculation can be significantly reduced.

Therefore, by using a pulse sequential optimization search using the pulse position searching apparatus according to the claimed invention for a coding apparatus in a case where the preliminary selection number is sufficiently small, it is possible to further reduce the amount of calculation without deterioration of the coding performance.

The present embodiment will describe a case where the claimed invention is applied to quantization of a fixed codebook in CELP, which is a speech coding technology. Since CELP has been described above, the description thereof will be omitted.

As described in the Background Art, G.718 uses two-pulse searches using a closed multiplexed loop a plurality of times, and thereby searches many pulses while suppressing the amount of calculation. In the searches, a preliminary selection in the outer loop of track 0 limits the number of times of entering the inner loop to thereby achieve an additional reduction in the amount of calculation. Furthermore, by significantly narrowing down a search range in the beginning and then gradually increasing the number of candidates, the performance is prevented from deteriorating significantly. This takes advantage of a tendency for accurate searching of the last half part to prevent the performance from deteriorating significantly even when the first half part is searched by significantly narrowing down the search candidates by a preliminary selection.

Thus, the inventor of the claimed invention conceived of an idea that when the preliminary selection number was sufficiently small, a sequential optimization search using a loop for which a preliminary selection was performed was used a plurality of times to enable performance similar to that when using a simultaneous optimization search and to enable a significant reduction in the amount of calculation.

Furthermore, in the sequential optimization search, there are cases where pulse positions different from search results in the simultaneous optimization search may be searched (referred to as "position errors"). This may directly lead to deterioration in performance. For this reason, the present embodiment first performs a search using a loop for which a preliminary selection is performed to thereby stochastically reduce a probability of location error in the first loop, search another track, and then conduct a search using the loop for which a preliminary selection is performed over again. Thus, even when the search result using the first loop is not necessarily optimum, this improves the probability that a correct position may be eventually searched.

Furthermore, in the first loop, it is necessary to add two values; power (the same value as the "correlation value between the same pulse positions") of a synthetic vector of newly added pulses as the denominator term of the aforementioned cost function and a correlation value between synthetic vectors of pulses searched until then, to the synthetic value of the denominator term until before conducting the search. However, the calculation of this correlation value is omitted to calculate only power, and the amount of calculation necessary for preprocessing is thereby omitted.

Hereinafter, an embodiment of the claimed invention will be described in detail with reference to the accompanying drawings. Here, as an example, a pulse position searching apparatus will be described which searches pulse positions in a fixed codebook made up of an algebraic codebook in a CELP coding apparatus by dividing pulses into groups of two pulses each. This pulse position searching apparatus is applied to a fixed codebook searching apparatus included in the CELP coding apparatus, and pulses searched by this pulse position searching apparatus are organized into a pulse sequence and coded in the fixed codebook searching apparatus. The CELP coding apparatus targets at, for example, speech, music or a signal which is a mixture of speech and music or the like. Furthermore, the pulse position searching apparatus is not limited to the CELP coding apparatus, but can also be used for a coding apparatus required to conduct a pulse position search.

Embodiment

Figure 9:
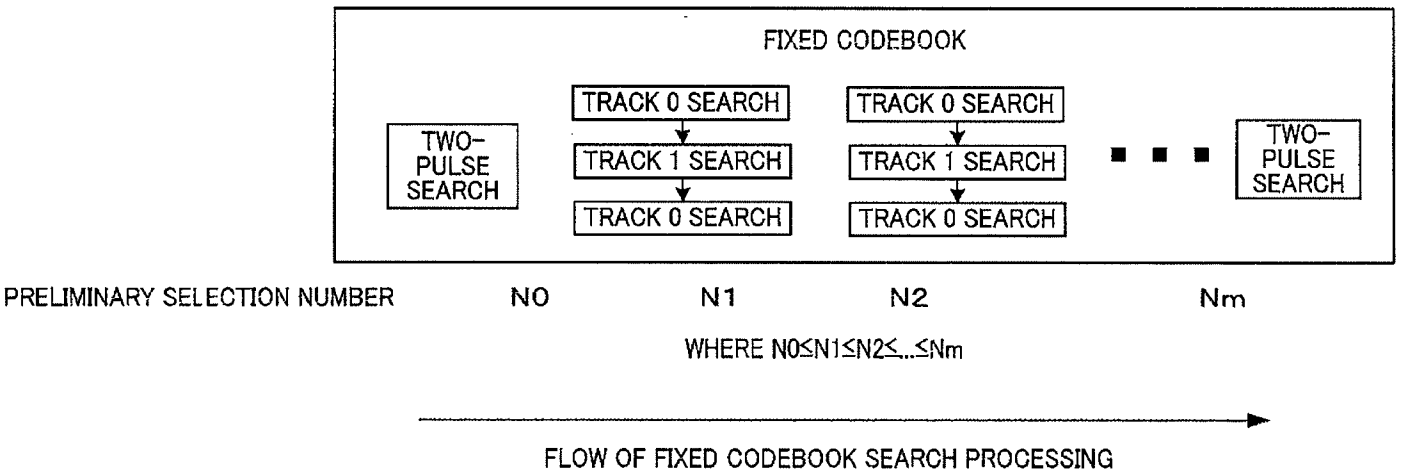
FIG. 9 is a conceptual diagram illustrating a flow of fixed codebook search processing according to an embodiment of the claimed invention.

A flow of search processing of a fixed codebook of the present embodiment will be described using FIG. 9. FIG. 9 is a conceptual diagram illustrating a flow of fixed codebook search processing according to the embodiment of the claimed invention.

As shown in FIG. 9, in search processing of the fixed codebook of the present embodiment, searches are gradually conducted by two pulses at a time from a pulse search with a small preliminary selection number to a pulse search with a large preliminary selection number, and searches are performed a necessary number of times until the required number of pulses are searched (the preliminary selection number may be the same). The results (pulses) obtained in the searches in the respective stages are organized into a pulse sequence (not shown). The description of the method for organizing the searched pulses into a pulse sequence is omitted. Furthermore, the present embodiment assumes that pulse searches are conducted in track 0 and track 1 of an algebraic codebook in the respective stages.

Figure 5:
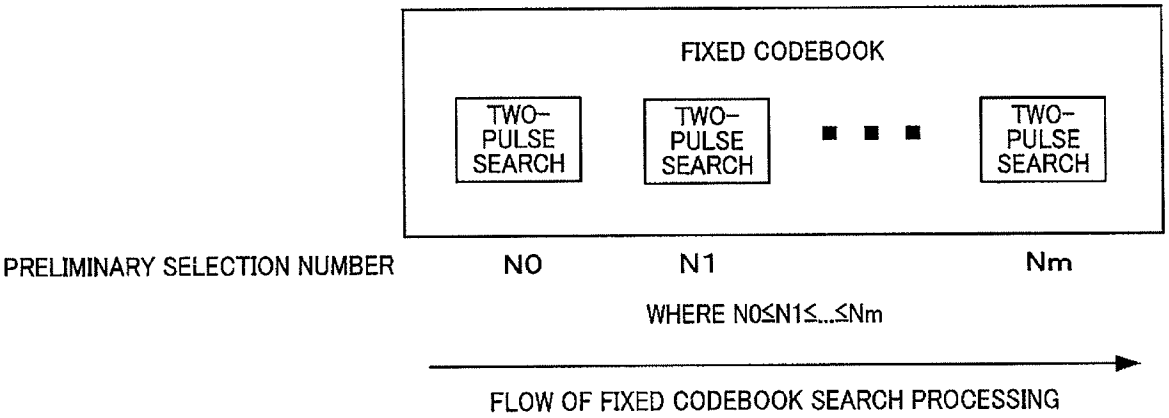
FIG. 5 is a conceptual diagram illustrating a flow of conventional fixed codebook search processing.
Figure 7:
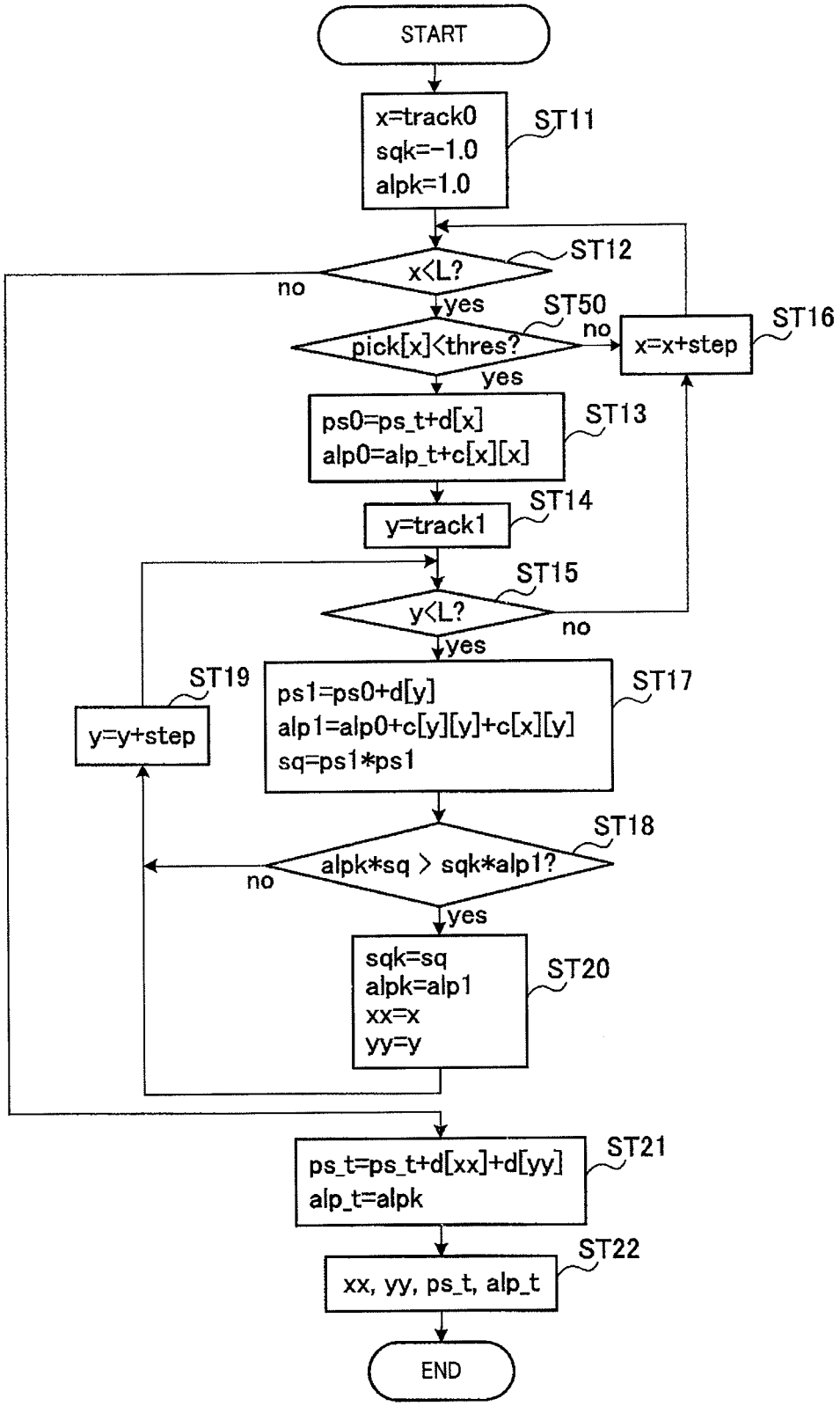
FIG. 7 is a flowchart illustrating an algorithm of searching pulse positions when performing a conventional preliminary selection of pulse positions.
Figure 8:
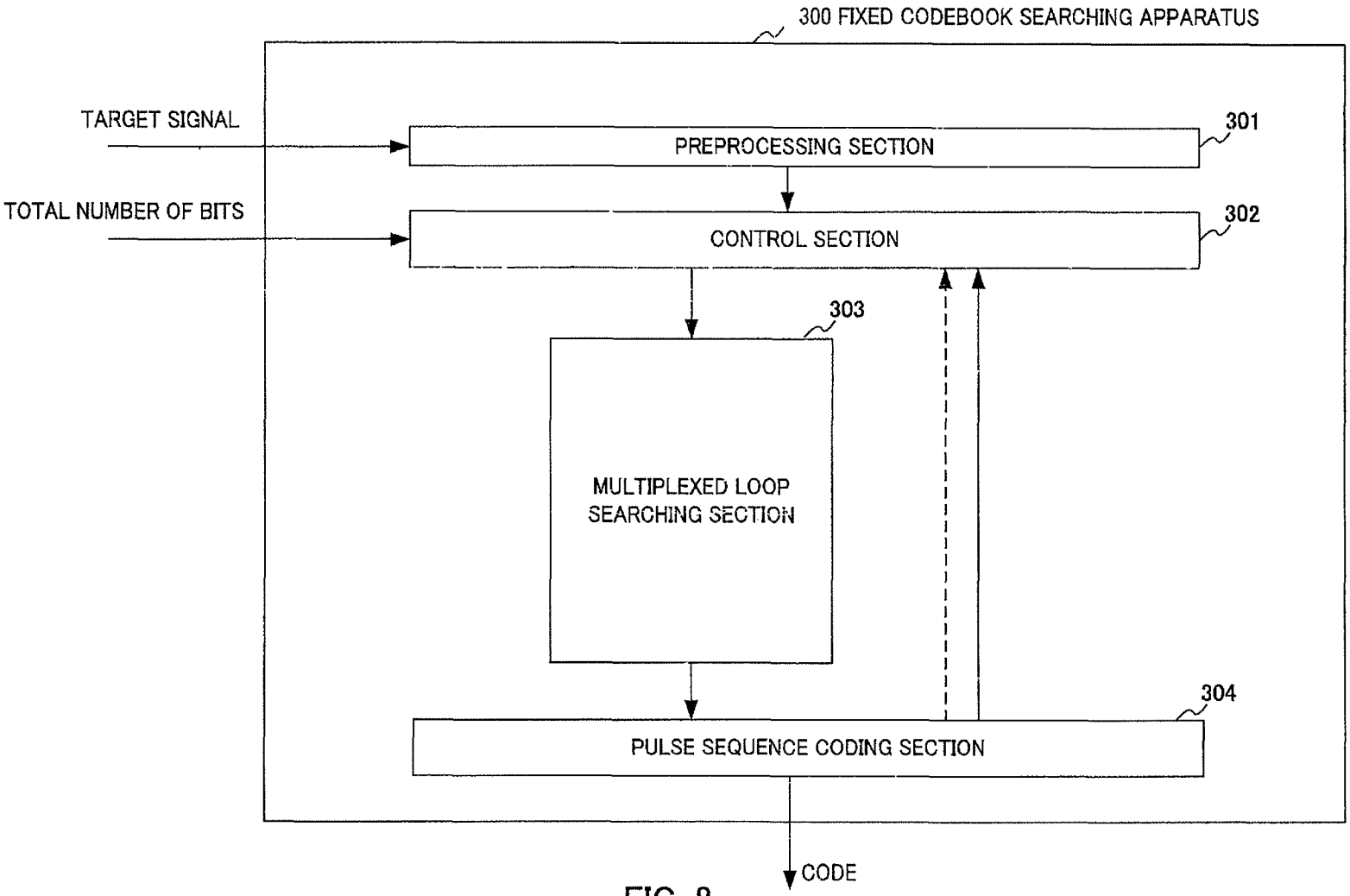
FIG. 8 is a block diagram illustrating a configuration of a conventional fixed codebook searching apparatus.

The search processing in FIG. 5 and the search processing in FIG. 9 are similar in that a two-pulse search is performed in the initial stage, but are different in that a sequential optimization search using the pulse position searching method according to the claimed invention is performed in the subsequent stages. Here, the "two-pulse search" refers to the simultaneous optimization search (closed-loop search) that performs a preliminary selection in FIG. 7 described in the Background Art. Furthermore, it is assumed in this example that the two-pulse search is performed again in the final stage.

In the present embodiment, the two-pulse search (closed-loop search) is adopted in the stage of the first search having smallest preliminary selection number N0. This is because in a real situation, if N0 is too small, the amount of calculation in this stage may be smaller in a closed-loop search than a sequential optimization search of the claimed invention. Furthermore, the two-pulse search is also adopted in the stage of the final search having largest preliminary selection number Nm. This is because the performance of the claimed invention is fully displayed when the preliminary selection number is sufficiently small as described above, and so the possibility is taken into consideration that the performance of the claimed invention may deteriorate in the final stage having the largest preliminary selection number. The present embodiment uses two-pulse searches in the initial and final stages, but this configuration may not necessarily be adopted.

In the example of FIG. 9, a sequential optimization search using the pulse position searching method according to the claimed invention is performed for the pulse search of the second stage or the like. That is, assuming that the preliminary selection number is sufficiently small in this stage, a search is conducted first for track 0 for which a preliminary selection is performed, the pulse position searched in track 0 is fixed next, a search is then conducted for track 1 without any preliminary selection, the position searched in track 1 is finally fixed, and a search is conducted again for track 0 for which a preliminary selection is performed.

Figure 10:
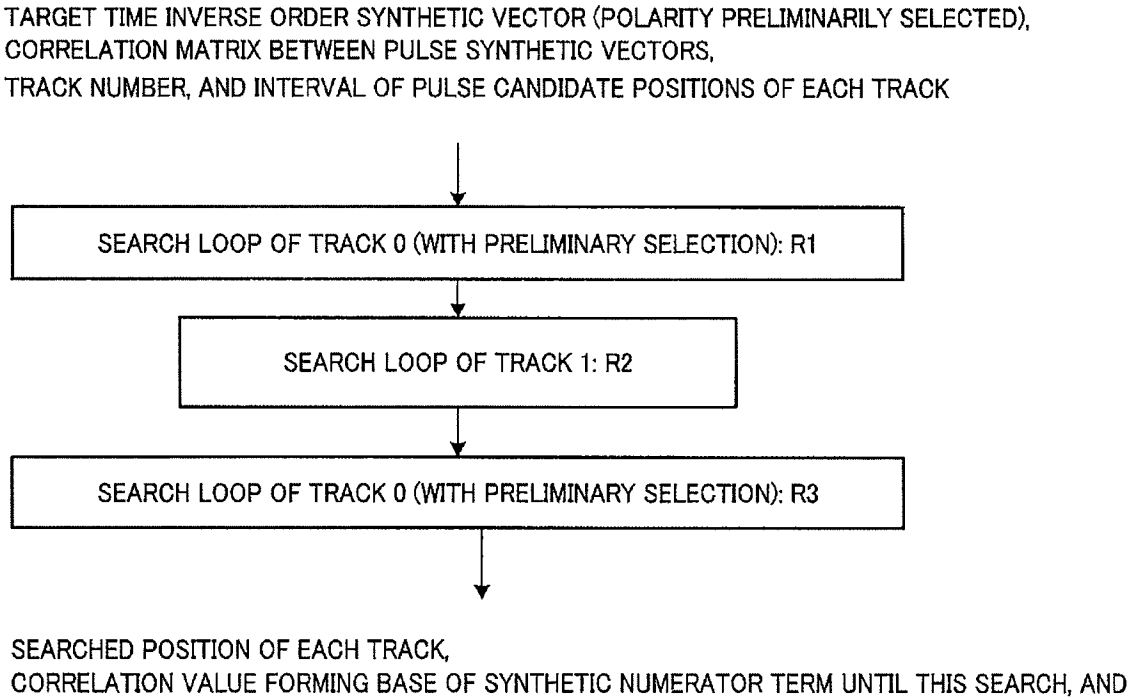
FIG. 10 is a diagram schematically illustrating an algorithm of searching pulse positions according to the embodiment of the claimed invention.

FIG. 10 is a diagram schematically illustrating an algorithm of searching pulse positions in the present embodiment. FIG. 10 corresponds to the pulse search in the second stage or the like shown in FIG. 9.

Figure 3:
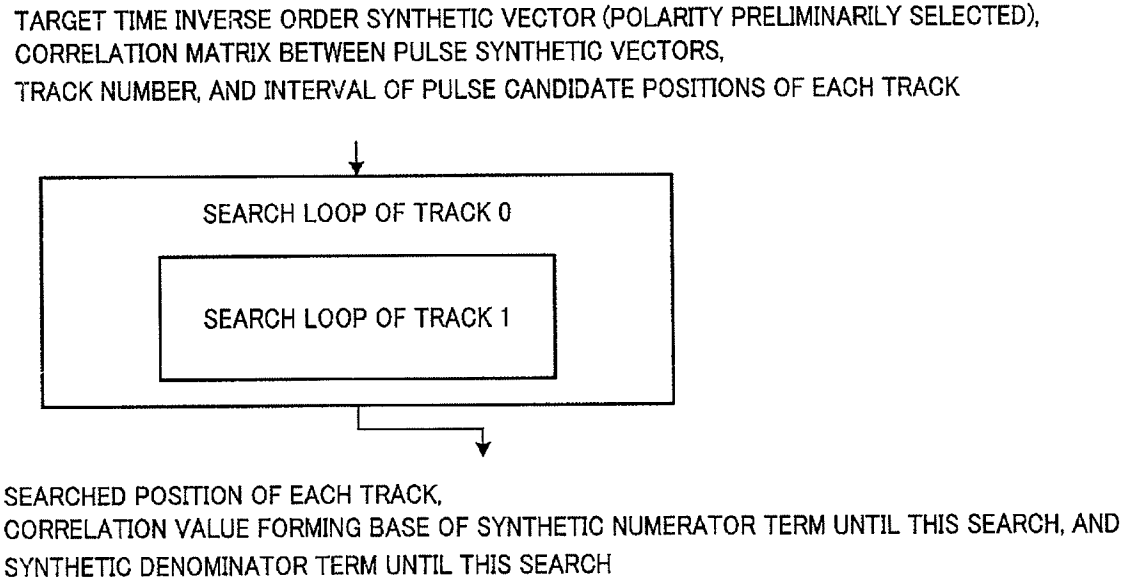
FIG. 3 is a diagram schematically illustrating an algorithm of searching pulse positions by conventional grouping.
Figure 4:
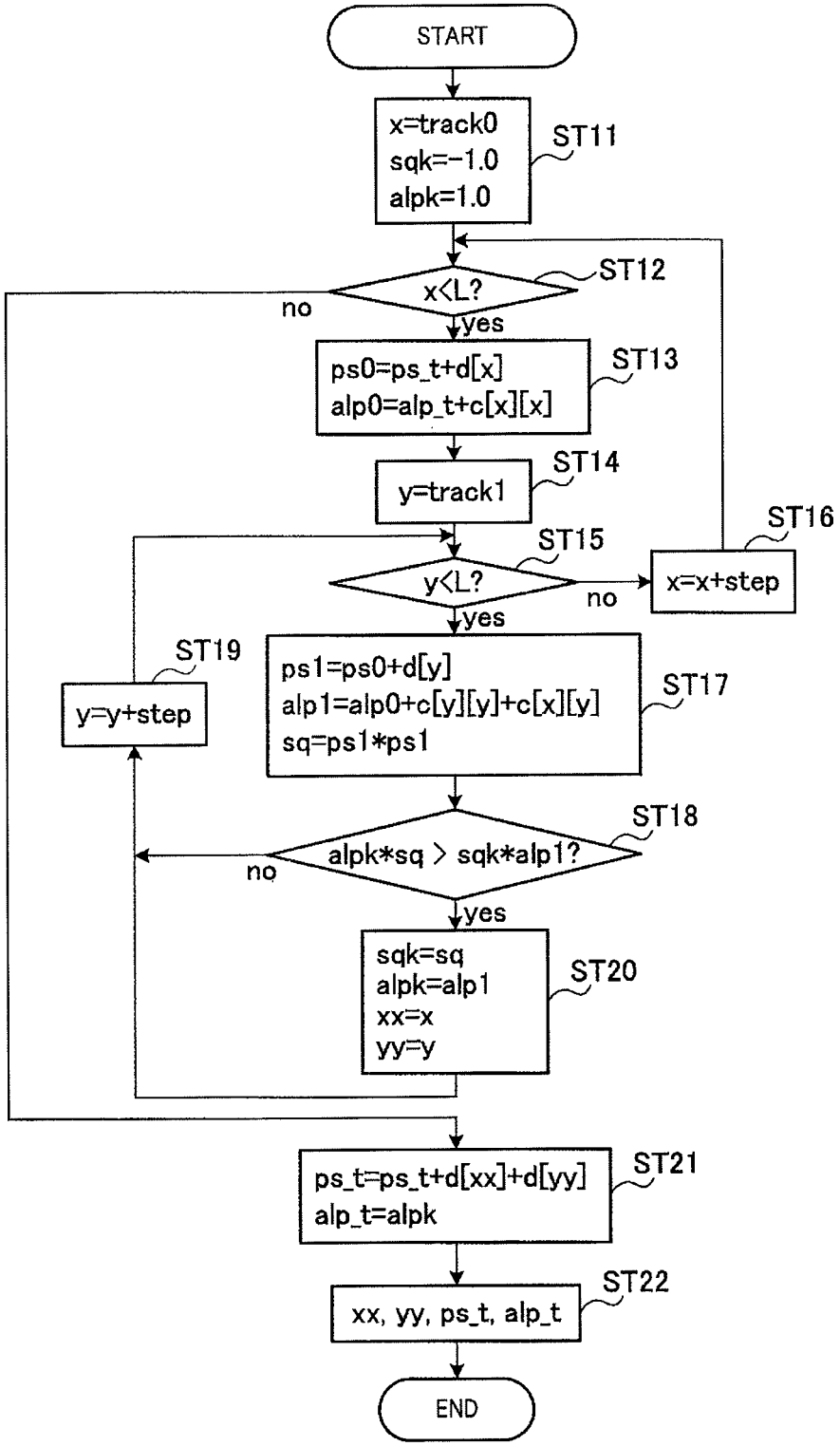
FIG. 4 is a flowchart illustrating an algorithm of searching pulse positions by conventional grouping.
Figure 6:
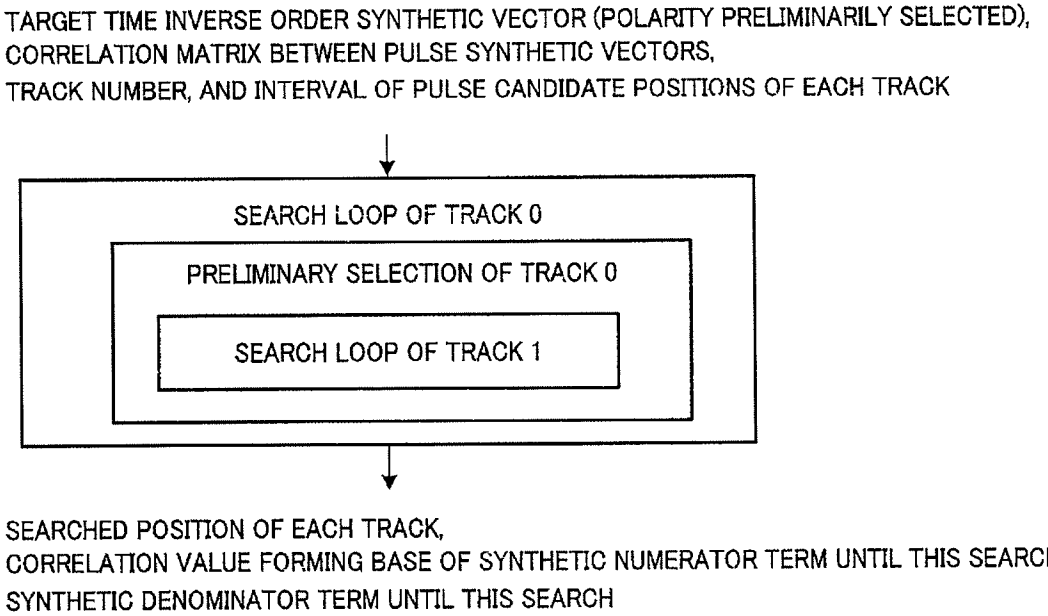
FIG. 6 is a diagram schematically illustrating an algorithm of searching pulse positions when performing a conventional preliminary selection of pulse positions.

As in the cases of FIG. 3 and FIG. 6, before starting a search, parameters necessary for a search are obtained using an inputted target or the like as preprocessing. Here, the target can be expressed by a vector and the target corresponds to target vector v of the aforementioned fixed codebook search. As parameters, target time inverse order synthetic vector (polarity preliminarily selected) $v'H$, correlation matrix between pulse synthetic vectors (polarity preliminarily selected) $H'H$, track number, and interval of pulse candidate positions in each track or the like are provided.

Using these parameters, search loop R1 is executed first for track 0 for which a preliminary selection is performed, the pulse position searched in track 0 is then fixed, search loop R2 is executed for track 1 without performing any preliminary selection, and the position searched in track 1 is finally fixed to execute search loop R3 again for track 0 for which a preliminary selection is performed. Through this processing, the searched position of each track, the correlation value which forms the base of the synthetic numerator term until this search, and the synthetic denominator term until this search are obtained.

That is, as shown in FIG. 10, the present embodiment does not adopt the multiplexed loop unlike the conventional algorithm shown in FIG. 3 and FIG. 6 and uses an algorithm of performing a search loop of track 0 and a search loop of track 1 in the above-described order, and can thereby reduce the amount of calculation involved in the pulse position search.

Figure 11:
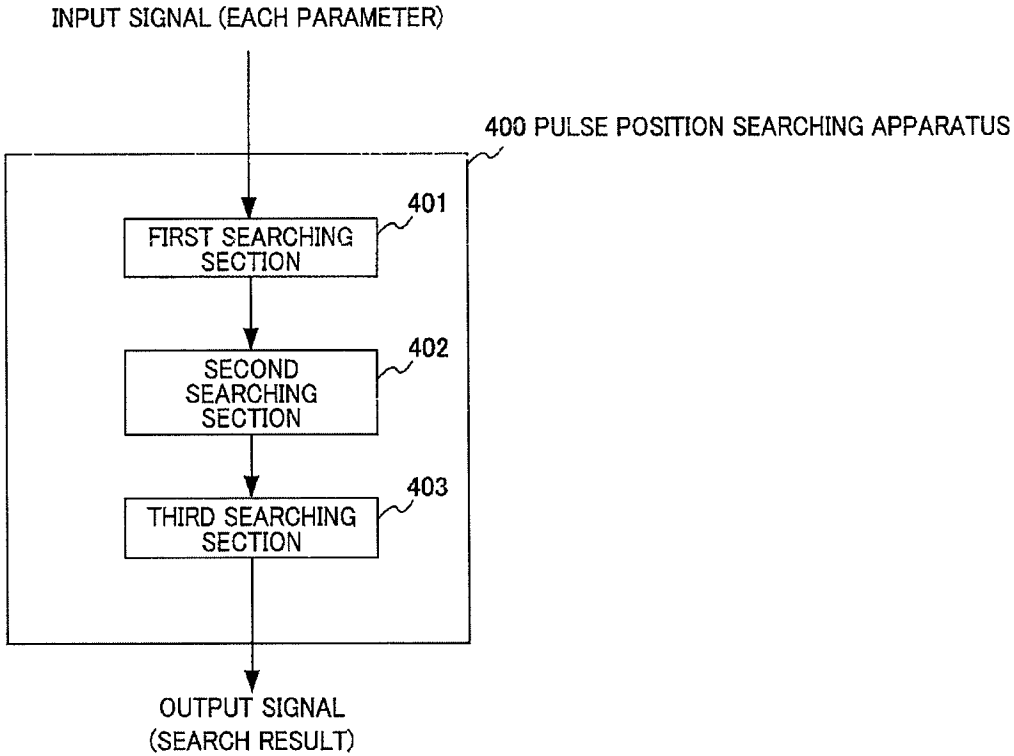
FIG. 11 is a block diagram illustrating a configuration of a pulse position searching apparatus according to the embodiment of the claimed invention.

FIG. 11 is a block diagram illustrating a configuration of pulse position searching apparatus 400 according to the embodiment of the claimed invention. FIG. 11 corresponds to the sequential optimization search shown in FIG. 10.

Pulse position searching apparatus 400 includes first searching section 401 that executes search loop R1 of track 0 for which a preliminary selection is performed, second searching section 402 that executes search loop R2 of track 1 without any preliminary selection and third searching section 403 that executes search loop R3 of track 0 for which a preliminary selection is performed. The number of pulses to be obtained by the search is two.

First searching section 401 receives, as an input signal, parameters such as a target time inverse order synthetic vector with a preliminarily selected polarity, correlation matrix between pulse synthetic vectors, track number, and interval of pulse position candidates of each track, and searches the position of one pulse while performing a preliminary selection of pulse positions using these parameters. First searching section 401 outputs the search result to second searching section 402.

Second searching section 402 fixes the pulse position inputted from first searching section 401 as the search result and searches a pulse position in next track 1 without any preliminary selection of the pulse position. Second searching section 402 outputs the search result to third searching section 403.

Third searching section 403 fixes the pulse position inputted from second searching section 402 as the search result and searches a pulse again for the pulse position in track 0 while performing a preliminary selection of the pulse position. Third searching section 403 outputs the searched position of each track obtained by the search over again, a correlation value which forms the base of the synthetic numerator term of cost function C until this search and the synthetic denominator term of cost function C until this search as an output signal.

Figure 12:
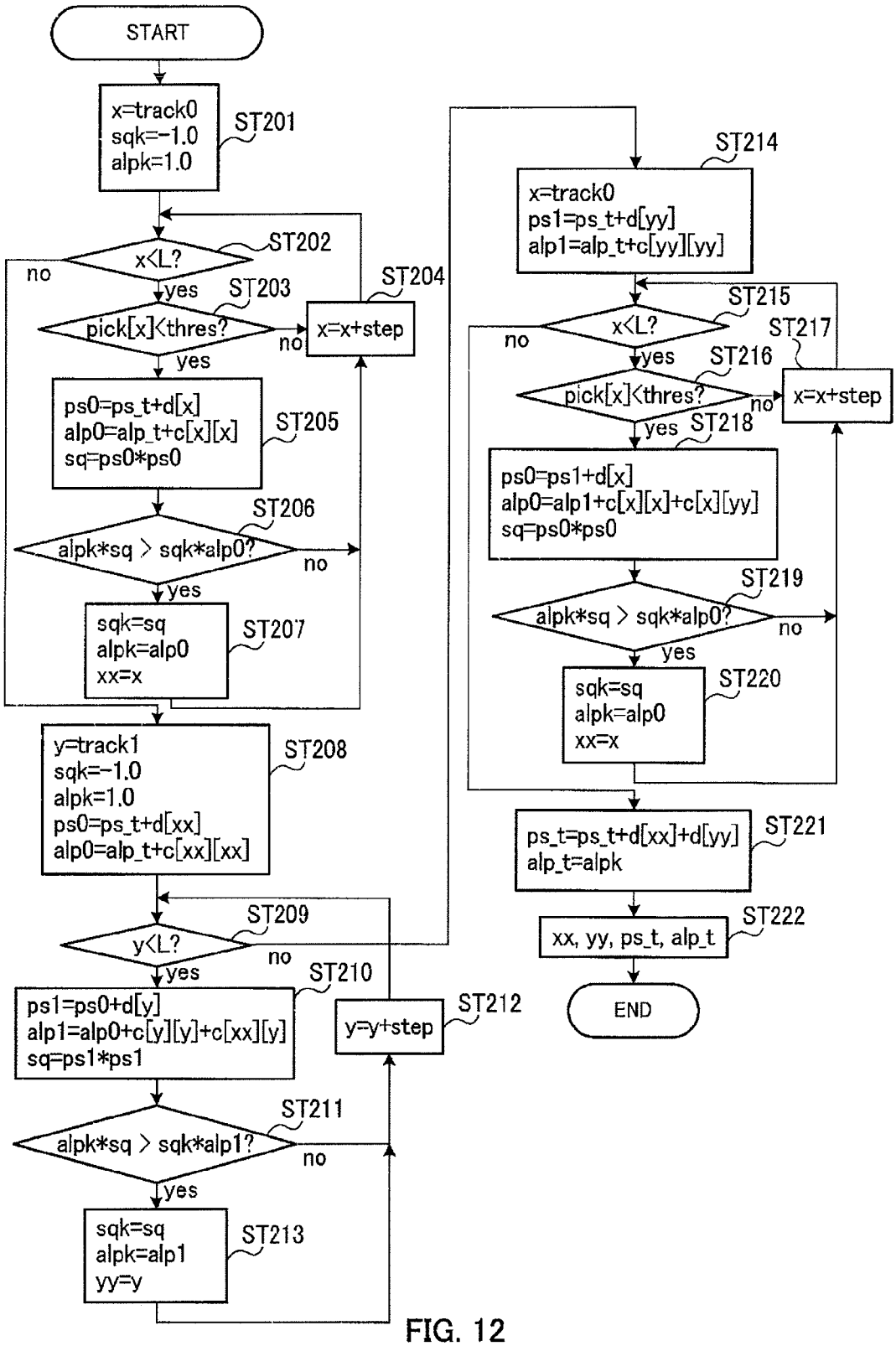
FIG. 12 is a flowchart illustrating a method of searching pulse positions according to the embodiment of the claimed invention.

FIG. 12 is a flowchart illustrating a method of searching pulse positions of the present embodiment. FIG. 12 specifically illustrates operation of pulse position searching apparatus 400 in FIG. 11.

In FIG. 12, symbol "d[n]" is a target time inverse order synthetic vector (polarity preliminarily selected). Symbol "c[n][m]" denotes a correlation matrix between pulse synthetic vectors (polarity preliminarily selected), where n≠m and the values of n and m are doubled. Symbols "x" and "y" denote pulse candidate positions. Symbols "xx" and "yy" denote finally searched positions. "Track 0" or "track 1" denotes a track number (one of 0, 1, 2 and 3 in the present embodiment). Symbol "p_t" denotes the base of the numerator term of cost function C until before conducting a search. Symbol "alp_t" denotes a synthetic value of the denominator term of cost function C until before conducting a search. Symbol "L" denotes a subframe length. Symbol "step" denotes an interval ("4" in the present embodiment) of the pulse candidate position of each track. Symbol "pick[n]" denotes a sequence in which the order of adopting each pulse position is described in the pulse candidate position. Symbol "thres" denotes a value obtained from the specified number of candidates of candidate position x. Furthermore, the specified number of candidates are searched through a search only when pick[n] is a value smaller than the value of thres.

From FIG. 12, in order to search pulse candidate position x, first searching section 401 sets numerator term sqk to "−1.0" and sets denominator term alpk to "1.0" of cost function C (step ST201).

Next, first searching section 401 determines whether or not pulse candidate position x is smaller than subframe length L (step ST202).

When pulse candidate position x is smaller than subframe length L (step ST202: yes), first searching section 401 determines whether or not pick[x] is smaller than the value of thres (step ST203).

When pick[x] is equal to or greater than the value of thres (step ST203: no), first searching section 401 shifts to a search of next candidate position x (x=x+step) (step ST204), and returns the process to step ST202.

On the other hand, when pick[x] is smaller than the value of thres (step ST203: yes), first searching section 401 performs calculations ps0=ps_t+d[x], alp0=alp_t+c[x][x] and sq=ps0*ps0 (step ST205). Here, as the denominator term of cost function C, power c[x][x] (the same value as a correlation value between the same pulse positions) of newly added pulse synthetic vector and correlation value c[x][*] between pulse synthetic vectors searched so far need to be added to a synthetic value of the denominator term of cost function C until before conducting a search. However, the calculation of this correlation value c[x][*] is omitted to calculate only power c[x][x], and the amount of calculation necessary for preprocessing is thereby omitted.

Furthermore, first searching section 401 determines whether or not the value of (alpk*sq) is greater than the value of (sqk*alp0) (step ST206).

When the value of (alpk*sq) is equal to or smaller than the value of (sqk*alp0) (step ST206: no), first searching section 401 shifts to a search of next candidate position x (x=x+step) (step ST204) and returns the process to step ST202.

On the other hand, when the value of (alpk*sq) is greater than the value of (sqk*alp0) (step ST206: yes), first searching section 401 fixes the denominator term and the numerator term of cost function C and fixes final pulse position xx (step ST207).

Furthermore, in step ST202, when pulse candidate position x is equal to or greater than subframe length L (step ST202: no), second searching section 402 sets numerator term sqk of cost function C to "−1.0", sets denominator term alpk to "1.0", and performs calculations ps0=ps_t+d[xx] and alp0=alp_t+c[xx][xx] (step ST208).

Next, second searching section 402 determines whether or not pulse candidate position y is smaller than subframe length L (step ST209).

When pulse candidate position y is smaller than subframe length L (step ST209: yes), second searching section 402 performs calculations ps1=ps0+d[y], alp1=alp0+c[y][y]+c[xx][y] and sq=ps1*ps1 (step ST210).

Next, second searching section 402 determines whether or not the value of (alpk*sq) is greater than the value of (sqk*alp1) (step ST211).

When the value of (alpk*sq) is equal to or smaller than the value of (sqk*alp1) (step ST211: no), second searching section 402 shifts to a search of next candidate position y (y=y+step) (step ST212) and returns the process to step ST209.

On the other hand, when the value of (alpk*sq) is greater than the value of (sqk*alp1) (step ST211: yes), second searching section 402 fixes the denominator term and numerator term of cost function C and fixes final pulse position yy (step ST213).

In step ST209, when pulse candidate position y is equal to or greater than subframe length L (step ST209: no), third searching section 403 performs calculations ps1=ps_t+d[yy] and alp1=alp_t+c[yy][yy] (step ST214).

Next, third searching section 403 determines whether or not pulse candidate position x is smaller than subframe length L (step ST215).

When pulse candidate position x is smaller than subframe length L (step ST215: yes), third searching section 403 determines whether or not pick[x] is smaller than the value of thres (step ST216).

When pick[x] is equal to or greater than the value of thres (step ST216: no), third searching section 403 shifts to a search of next candidate position x (x=x+step) (step ST217) and returns the process to step ST215.

On the other hand, when pick[x] is smaller than the value of thres (step ST216: yes), third searching section 403 performs calculations ps0=ps1+d[x], alp0=alp1+c[x][x]+c[x][yy] and sq=ps0*ps0 (step ST218).

Next, third searching section 403 determines whether or not the value of (alpk*sq) is greater than the value of (sqk*alp0) (step ST219).

When the value of (alpk*sq) is equal to or smaller than the value of (sqk*alp0) (step ST219: no), third searching section 403 shifts to a search of next candidate position x (x=x+step) (step ST217), and returns the process to step ST215.

On the other hand, when the value of (alpk*sq) is greater than the value of (sqk*alp0) (step ST219: yes), third searching section 403 fixes the denominator term and the numerator term of cost function C and fixes final pulse position xx (step ST220).

Furthermore, in step ST215, when pulse candidate position x is equal to or greater than subframe length L (step ST215: no), third searching section 403 performs calculations ps_t=ps_t+d[xx]+d[yy] and alp_t=alpk (step ST221).

Next, third searching section 403 outputs final pulse positions xx and yy, and the values of synthetic value alp_t of the denominator term and of numerator term ps_t of cost function C at this time (step ST222).

In FIG. 10, search loop R1 of track 0 corresponds to the processing in step ST201 to step ST208 in FIG. 12, search loop R2 of track 1 corresponds to step ST208 to step ST214 in FIG. 12, and search loop R3 of track 0 corresponds to step ST214 to step ST221 in FIG. 12.

Figure 13:
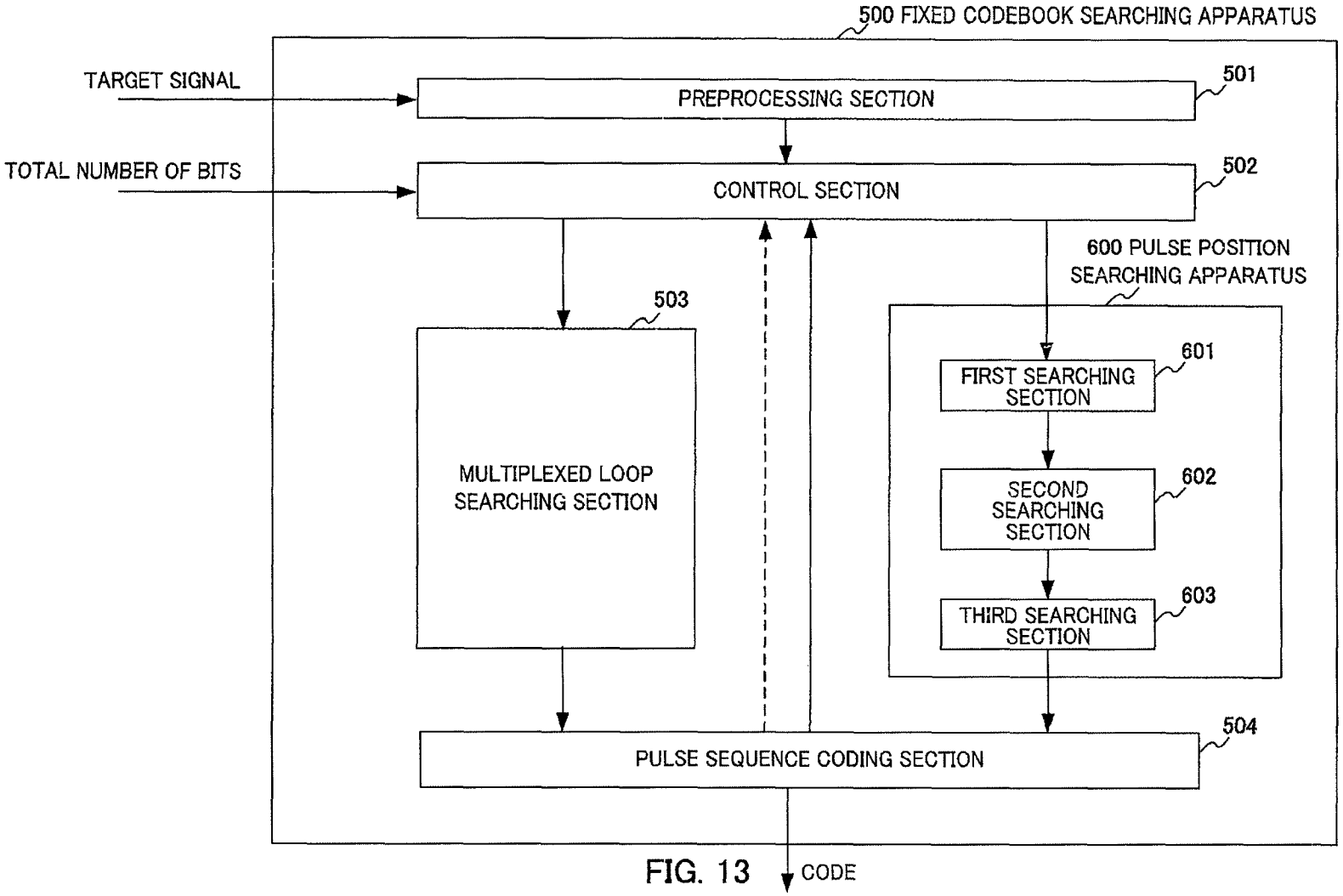
FIG. 13 is a block diagram illustrating a configuration of the fixed codebook searching apparatus according to the embodiment of the claimed invention.

FIG. 13 is a block diagram illustrating a configuration of fixed codebook searching apparatus 500 capable of conducting a pulse search of a fixed codebook using the pulse searching method of the present embodiment.

Preprocessing section 501 receives a target signal as input and obtains parameters necessary for a pulse search. Examples of parameters generated by calculation include a "target time inverse order synthetic vector" which reflects the result of a polarity preliminary selection of each pulse position (corresponding to $v'H$ of equation 4) and "correlation matrix between pulse synthetic vectors" (corresponding to $H'H$ of equation 4) which reflects the result of the polarity preliminary selection and doubles the value other than the diagonal term. Furthermore, examples of parameters to be set include a track number to be searched, interval of pulse position candidates in the track with the above-described number, subframe length, and preliminary selection number. Preprocessing section 501 sends these parameters to control section 502.

Control section 502 receives the total number of bits as input, sends parameters necessary for a pulse search to multiplexed loop searching section 503 or pulse position searching apparatus 600 according to a timing signal from pulse sequence coding section 504, which will be described later, and performs control so that multiplexed loop searching section 503 or pulse position searching apparatus 600 conducts a pulse search. In the present embodiment, control section 502 performs control so as to drive multiplexed loop searching section 503 in the first and final stages and drive pulse position searching apparatus 600 in other stages.

Examples of parameters to be sent to multiplexed loop searching section 503 or pulse position searching apparatus 600 include, in addition to the parameters sent from preprocessing section 501, a sequence in which the order of adopting each pulse position is described in the pulse position, synthetic value of the numerator term until before conducting a search and synthetic value of the denominator term. Control section 502 initializes the synthetic value of the numerator term and the synthetic value of the denominator term until before conducting a search when first driving multiplexed loop searching section 503 in the first stage and sends the values sent from pulse sequence coding section 504 to multiplexed loop searching section 503 when conducting a two-pulse search (closed-loop search) in the subsequent stages (final stage in the example in FIG. 9).

Multiplexed loop searching section 503 searches pulse positions using a two-pulse search, that is, a closed-loop search using a multiplexed loop. In this case, multiplexed loop searching section 503 performs a preliminary selection in the outermost loop using the preliminary selection number and the sequence in which the order of adopting each pulse position is described in the pulse position, and outputs the searched pulse position, and the synthetic value of the numerator term and the synthetic value of the denominator term calculated in the pulse position to pulse sequence coding section 504.

Pulse position searching apparatus 600 corresponds to pulse position searching apparatus 400 shown in FIG. 11. Therefore, first searching section 401, second searching section 402 and third searching section 403 correspond to first searching section 601, second searching section 602 and third searching section 603 respectively, and have the same configuration. For this reason, detailed description of pulse position searching apparatus 600 will be omitted.

Pulse sequence coding section 504 performs pulse coding using pulse positions searched in multiplexed loop searching section 503 or pulse position searching apparatus 600, synthetic value of the numerator term and synthetic value of the denominator term. This pulse coding as a fixed codebook is performed using the result of multiplexed loop searching section 503 and the result of pulse position searching apparatus 600. Pulse sequence coding section 504 sends the synthetic value of the numerator term and the synthetic value of the denominator term to control section 502, and sends a timing signal to control section 502 to prompt the next operation of pulse position searching apparatus 600 or operation of multiplexed loop searching section 503. Pulse sequence coding section 504 then finally outputs the code as the fixed codebook.

Thus, in a search for a small number of pulses, the pulse position searching apparatus of the present embodiment conducts a sequential optimization search by sequentially executing loops in order of a search loop of track 0 in which a preliminary selection is performed without adopting a multiplexed loop, a search loop of track 1 in which no preliminary selection is performed, and a search loop of track 0 in which a preliminary selection is performed, and can thereby reduce the amount of calculation involved in the pulse position search compared to related art. Furthermore, when this pulse position searching apparatus is applied to a fixed codebook searching apparatus, even when the number of pulses to be searched in the fixed codebook increases, it is possible to reduce the amount of calculation involved in a pulse position search without deteriorating coding performance. By applying such a fixed codebook searching apparatus to a coding apparatus, it is possible to generate a high quality decoded signal when decoding a code in the decoding apparatus.

Furthermore, according to the present embodiment, the pulse position searching apparatus first searches track 0 with a preliminary selection for pulse positions, and can thereby reduce the possibility of obtaining a result different from a result of a search conducted in a conventional multiplexed loop.

According to the present embodiment, the pulse position searching apparatus searches track 0 with a preliminary selection for pulse positions again after searching track 1, and can thereby reduce the possibility of obtaining a result different from a result of a search conducted in a conventional multiplexed loop.

According to the present embodiment, the pulse position searching apparatus calculates the denominator term of a cost function used to search track 0 with a preliminary selection for pulse positions to be used first by adding only power of a pulse synthetic vector to the synthetic value of the denominator term, and can thereby save the amount of calculation necessary to calculate a correlation value, and further reduce the amount of calculation.

The present embodiment conducts a search for every two pulses, but this is for a comparison with G.718 which is a conventional example, and can conduct a search for every arbitrary number of pulses such as three pulses or four pulses.

The fixed codebook searching apparatus of the present embodiment uses a conventional simultaneous optimization search (closed-loop search) in the first and final stages, but this configuration need not always be adopted.

In the fixed codebook searching apparatus of the present embodiment, the control section may determine to conduct a pulse position search in the pulse group search in the final stage using a simultaneous optimization search (closed-loop search) no matter what the total number of bits is.

Although the present embodiment adopts a three-loop configuration for a sequential optimization search of the claimed invention: search of track 0 (with preliminary selection), search of track 1 (no preliminary selection) and search of track 0 (with a preliminary selection), the claimed invention is not limited to this, but the amount of calculation can be significantly reduced, and the number of loops may, therefore, be further increased.

Although the present embodiment uses an algebraic codebook as the fixed codebook, the claimed invention is not limited to this, but any codebook other than the algebraic codebook may also be used.

Although the present embodiment conducts a search using a preliminary selection by taking G.718 as an example, the claimed invention is not limited to this, but may also be used for arbitrary coding using a plurality of searches for a small number of pulses. This is because the claimed invention is an invention related to a pulse position search and is independent of other configurations of the G.718 standard.

Although the present embodiment adopts CELP as a coding scheme, the claimed invention is not limited to this, but since the claimed invention can also be used for vector quantization, the claimed invention is applicable to any coding scheme other than CELP. For example, the claimed invention is also applicable to spectral quantization using MDCT (Modified Discrete Cosine Transform) or QMF (Quadrature Mirror Filter) and is also applicable to an algorithm of searching a similar spectral shape from among spectra in a low frequency domain of a band extension technology.

Although the present embodiment has shown a case where the pulse position searching apparatus is applied to a coding apparatus targeting at speech, music or a signal which is a mixture of speech and music, the claimed invention is not limited to this, but the claimed invention is also applicable to quantization used for speech recognition, image recognition or image coding or the like. This is because the claimed invention is an invention related to a pulse position search and is independent of the object of the entire algorithm.

In the foregoing embodiment, the claimed invention is configured with hardware by way of example, but the invention may also be implemented by software in cooperation with hardware.

Furthermore, each function block employed in the explanation of the aforementioned embodiment may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor where connections and settings of circuit cells within an LSI can be reconfigured is also possible.

If a new integrated circuit implementation technology replacing LSI is introduced because of advancement in semiconductor technology or a different technology derived therefrom, the function blocks may of course be integrated using that technology. For example, application of biotechnology is also possible.

The disclosure of Japanese Patent Application No. 2011-133750, filed on Jun. 15, 2011, including the specification, drawings and abstract, is incorporated herein by reference in its entirety.

INDUSTRIAL APPLICABILITY

The claimed invention is suitable for use in a pulse position searching apparatus that searches a plurality of pulse positions or a codebook searching apparatus that searches a plurality of pulse positions making up a codebook, and is further applicable to a speech coding apparatus.

REFERENCE SIGNS LIST

400, 600 Pulse position searching apparatus
401, 601 First searching section
402, 602 Second searching section
403, 603 Third searching section
500 Fixed codebook searching apparatus
501 Preprocessing section
502 Control section
503 Multiplexed loop searching section
504 Pulse sequence coding section

The invention claimed is:

1. A fixed codebook searching apparatus, comprising:

a preprocessing circuit that receives a target audio signal as input and obtains parameters for a pulse search;

a control circuit that sends the parameters to a multiplexed loop searching circuit or a pulse position searching apparatus according to a timing signal, and performs control so as to drive the multiplexed loop searching circuit in the first and final stages and drive the pulse position searching apparatus in other stages;

the multiplexed loop searching circuit that searches pulse positions where two pulses are placed by performing a closed-loop search using a multiplexed loop, and calculates a synthetic value of a numerator term and a synthetic value of a denominator term in the searched pulse position;

the pulse position searching apparatus that includes a first searching circuit that performs a first search of track 0 for which a preliminary selection is performed, a second searching circuit that performs a second search of track 1 without any preliminary selection and a third searching circuit that performs a third search of track 0 for which a preliminary selection is performed, and searches pulse positions where two pulses are placed by performing a sequential optimization search, and calculates a synthetic value of a numerator term and a synthetic value of a denominator term in the searched pulse position; and a pulse sequence coding circuit that performs pulse coding using the pulse positions searched in the multiplexed loop searching circuit or the pulse position searching apparatus, the synthetic value of the numerator term and the synthetic value of the denominator term; wherein the first searching circuit inputs the parameters and performs the first search of track 0 with the preliminary selection using the parameters on a first candidate group of positions where a first pulse is placed, to obtain a first position where the first pulse is placed;

the second searching circuit fixes the first position inputted from the first searching circuit, and performs a second search of track 1 without any preliminary selection using the first position on all position candidates of a second candidate group of positions where a second pulse is placed, to obtain a second position where the second pulse is placed finally; and the third searching circuit fixes the second position inputted from the second searching circuit, performs the third search of track 0 with a second preliminary selection using the second position on the first candidate group, to obtain a third position where the first pulse is placed finally, and outputs the second position and the third position as a search result.

2. A fixed codebook searching apparatus, comprising:

a memory that stores executable instructions;

a processor that executes the executable instructions;

a multiplexed loop searching circuit;

a pulse position searching apparatus that includes a first searching circuit, a second searching circuit, and a third searching circuit, and a pulse sequence coding circuit, wherein, when executed by the processor, the instructions cause the fixed codebook searching apparatus to perform operations comprising:

receiving a target audio signal as input and obtaining parameters for a pulse search;

sending the parameters to the multiplexed loop searching circuit or the pulse position searching apparatus according to a timing signal, and performing control so as to drive the multiplexed loop searching circuit in the first and final stages and drive the pulse position searching apparatus in other stages;

searching, by the multiplexed loop searching circuit, pulse positions where two pulses are placed by performing a closed-loop search using a multiplexed loop, and calculating a synthetic value of a numerator term and a synthetic value of a denominator term in the searched pulse position;

performing, by the first searching circuit, a first search of track 0 for which a preliminary selection is performed, performing, by the second searching circuit, a second search of track 1 without any preliminary selection;

performing, by the third searching circuit, a third search of track 0 for which a preliminary selection is performed, searching pulse positions where two pulses are placed by performing a sequential optimization search, and calculating a synthetic value of a numerator term and a synthetic value of a denominator term in the searched pulse position; and performing by the pulse sequence coding circuit, pulse coding using the pulse positions searched in the multiplexed loop searching circuit or the pulse position searching apparatus, the synthetic value of the numerator term and the synthetic value of the denominator term;

wherein the first searching circuit inputs the parameters and performs the first search of track 0 with the preliminary selection using the parameters on a first candidate group of positions where a first pulse is placed, to obtain a first position where the first pulse is placed;

wherein the second searching circuit fixes the first position inputted from the first searching circuit, and performs a second search of track 1 without any preliminary selection using the first position on all position candidates of a second candidate group of positions where a second pulse is placed, to obtain a second position where the second pulse is placed finally; and wherein the third searching circuit fixes the second position inputted from the second searching circuit, performs the third search of track 0 with a second preliminary selection using the second position on the first candidate group, to obtain a third position where the first pulse is placed finally, and outputs the second position and the third position as a search result.

* * * * *